US011465811B2

(12) United States Patent
Bang et al.

(10) Patent No.: US 11,465,811 B2
(45) Date of Patent: Oct. 11, 2022

(54) EASY-TO-OPEN GUNNY SACK SEWN BY SINGLE THREAD

(71) Applicants: GREEN PACKING CO., LTD., Pyeongtaek-si (KR); Bongjin Bang, Seoul (KR); Kiok Om, Goyang-si (KR); Sanghyun Cho, Goyang-si (KR)

(72) Inventors: Bongjin Bang, Seoul (KR); Kiok Om, Goyang-si (KR)

(73) Assignees: GREEN PACKING CO., LTD., Pyeongtaek-si (KR); Bongjin Bang, Seoul (KR); Kiok Om, Goyang-si (KR); Sang Hyeon Cho, Goyang-si (KR)

( * ) Notice: Subject to any disclaimer, the term of this patent is extended or adjusted under 35 U.S.C. 154(b) by 249 days.

(21) Appl. No.: 16/618,256

(22) PCT Filed: May 30, 2018

(86) PCT No.: PCT/KR2018/006145
§ 371 (c)(1),
(2) Date: Nov. 29, 2019

(87) PCT Pub. No.: WO2018/221955
PCT Pub. Date: Dec. 6, 2018

(65) Prior Publication Data

US 2020/0148425 A1 May 14, 2020

(30) Foreign Application Priority Data

Jun. 2, 2017 (KR) ..... 10-2017-0069282

(51) Int. Cl.
*B65D 33/26* (2006.01)
*B65D 33/18* (2006.01)
*B65D 33/34* (2006.01)

(52) U.S. Cl.
CPC ..... *B65D 33/26* (2013.01); *B65D 33/18* (2013.01); *B65D 33/34* (2013.01)

(58) Field of Classification Search
CPC ..... B65D 33/26; B65D 33/18; B65D 33/34
(Continued)

(56) References Cited

U.S. PATENT DOCUMENTS 1,855,473 A * 4/1932 Cerf ..... G09F 3/14 40/662
1,860,190 A * 5/1932 Le Vesconte ..... B65D 33/26 383/79

(Continued)

FOREIGN PATENT DOCUMENTS

CA 481328 A * 2/1952
JP 2000-255592 9/2000

(Continued)

*Primary Examiner* — Jes F Pascua
(74) *Attorney, Agent, or Firm* — Lex IP Meister, PLLC

(57) ABSTRACT

An easy-to-open gunny sack sewn by a single thread is disclosed. The easy-to-open gunny sack minimizes the costs of sewing a gunny sack through single thread sewing, allows a user to easily open the sack, prevents a sewing-finished section formed by single thread sewing from being easily loosened, and allows the user to easily identify an opening identification tape and to open the sack using the opening identification tape. The easy-to-open gunny sack allows a clip tape (20) to cover at least one of upper and lower ends of a sack portion, allows a single-thread sewing portion (10) by single thread sewing to be formed around the covered portion, allows an extended clip tape portion (21) formed by extension of the clip tape to be formed at both sides of the single-thread sewing portion (10), and allows an anti-loosening means to be provided at the extended clip tape portion (21) of the end portion placed in a sewing proceeding direction.

1 Claim, 7 Drawing Sheets

(58) Field of Classification Search
USPC ..... 383/78, 79, 92
See application file for complete search history.

(56) References Cited

U.S. PATENT DOCUMENTS

| | | | | | |
|---|---|---|---|---|---|
| 2,815,899 | A | * | 12/1957 | Swanson | B65D 77/34 383/92 |
| 2,978,164 | A | * | 4/1961 | Williams | B65D 33/26 383/79 |
| 3,030,003 | A | * | 4/1962 | Schanzle | B65D 33/26 383/79 |
| 3,100,596 | A | * | 8/1963 | Williams | B65D 33/26 383/79 |
| 3,116,009 | A | * | 12/1963 | Williams | B65D 33/26 383/79 |
| 3,228,585 | A | * | 1/1966 | Fleming | B65D 75/58 222/541.9 |
| 3,231,174 | A | * | 1/1966 | Fletcher | B65D 33/26 383/78 |

FOREIGN PATENT DOCUMENTS

| | | |
|---|---|---|
| KR | 1984-0002685 | 12/1984 |
| KR | 20-1997-0051730 | 9/1997 |
| KR | 20-0349085 | 4/2004 |
| KR | 10-2007-0021755 | 2/2007 |

* cited by examiner

EASY-TO-OPEN GUNNY SACK SEWN BY SINGLE THREAD

TECHNICAL FIELD

The present disclosure relates to an easy-to-open (or easy-open) gunny sack sewn by a single thread, and more particularly to an easy-to-open gunny sack in which at least one of upper and lower ends of a sack portion is covered by a clip tape, a sewing section corresponding to the portion covered by the clip tape is formed by single thread sewing in a manner that the cost of sewing the gunny sack is minimized due to such single thread sewing, an anti-loosening tape for preventing the sewing section from being easily loosened is attached to protrusion portions formed at both sides of the clip tape in a manner that the sewing-finished section formed by single thread sewing is prevented from being easily loosened, and a separate opening identification tape for identifying an opening of the gunny sack is also attached to allow a user to easily open the gunny sack.

BACKGROUND ART

Generally, a gunny sack may be used to contain and pack grains, feed, sugar, flour, chemicals, etc. Gunny sacks may be classified into a grain sack for containing grains, a feed sack for containing feed, a sugar or flour sack for containing sugar or flour, a sack for containing chemicals, etc., according to types of storage content to be contained therein.

The above-mentioned gunny sack may be generally composed of 1-ply to 4-ply Kraft paper or 1-ply to 4-ply synthetic resin sheet. According to various kinds of sealing methods for sealing the upper or lower end of the gunny sack, the gunny sack may also be classified into a sewing-type sack, a pasted valve (PV) sack, a pinch-bag type sack, an easy-open type sack, a pasted-valve-bag type sack, etc.

On the other hand, the end parts of the feed sack for storing feed or the grain sack for storing grain from among the above-mentioned gunny sacks may be usually sealed by sewing, such that the feed sack or the grain sack is usually manufactured in the form of a sewing-type sack.

The above-mentioned sewing-type sack may be provided with a sewing portion. In this case, the sewing portion may include a binding thread passing through the sack, and an opening thread for enabling the binding thread having passed through the sack to be hung in the form of a nose ring.

If the user wants to open the sewing portion of the conventional sewing-type sack, the user pulls the opening thread from the sewing portion to release the nose-ring connection state of the binding thread, such that a sewing thread of the sewing portion is loosened and the sewing portion can be opened.

However, the above-mentioned conventional sewing-type sack has to include the sewing portion composed of the binding thread and the opening thread, resulting in occurrence of relatively high costs in manufacturing the sewing-type sack.

In addition, the user may have difficulty in distinguishing between the binding thread and the opening thread contained in the conventional sewing-type sack. If the user having mistaken the binding thread for the opening thread pulls the binding thread instead of the opening thread, the sewn state of the sewing portion of the sack becomes tighter, such that the user is unable to open the sewing portion.

Meanwhile, the above sewing-type sack, an opening of which is sealed by sewing, has disadvantages in that the user has difficulty in easily opening the sack. In recent times, an easy open bag has recently been developed and rapidly come into widespread use, in which an upper end of the bag is not sewn and a folded portion is provided at the upper end of the bag so that the user can easily open the bag using the folded portion, as shown in FIG. 1. The above-mentioned easy open bag may serve as a gunny sack in which an upper end of an opening portion of the sack is folded at least two times and the folded portion of the sack is bonded to a sealing paper tape provided with an opening strap. As a result, the sealing paper tape bonded to the folded portion is severed by the opening strap, such that the user can easily open the easy open bag using the opening strap.

However, whereas the conventional easy open bag has advantages in that the user can easily open the sealing paper tape bonded to the folded portion by pulling the opening strap, the conventional easy open bag has disadvantages in that the sealing paper tape for sealing the folded portion is formed of expensive special paper and requires additional fabrication processes, such that production costs of the easy open bag unavoidably increase and thus price competitiveness of the easy open bag is significantly less than that of a disposable sack.

DISCLOSURE OF INVENTION

Solution to Problem

The present disclosure has been made in view of the above problems of the conventional sewing-type sack in which a sewing portion is formed of the binding thread and the opening thread such that high costs of sewing the sack are needed, the user has difficulty in distinguishing between the binding thread and the opening thread such that there is a higher possibility that the user pulls the binding thread instead of the opening thread by mistake and thus the sewn state of the sewing portion becomes tighter. As a result, it is impossible for the user to easily open the sewing portion of the conventional sack.

In addition, whereas the conventional easy open bag designed to solve the above problems in opening the conventional sack can be easily opened by the user, production costs needed to manufacture the easy open bag are considered high such that it is difficult for the easy open bag to be easily applied to many more application fields. Therefore, the present disclosure has been made to solve the above and other technical problems in view of cost efficiency.

Technical Solutions

In accordance with the present disclosure, an easy-to-open gunny sack is provided. The easy-to-open gunny sack may allow a clip tape to cover at least one of upper and lower ends of a sack portion, may allow a single-thread sewing portion by single thread sewing to be formed around the covered portion, may allow an extended clip tape portion formed by extension of the clip tape to be formed at both sides of the single-thread sewing portion, and may allow an anti-loosening means to be provided at the extended clip tape portion of the end portion placed in a sewing proceeding direction.

In accordance with the present disclosure, the extended clip tape portion may be comprised of three or more stitches formed by single thread sewing.

In accordance with the present disclosure, the anti-loosening means may be formed by injecting an adhesive into the last stitch of the single-thread sewing portion.

Advantageous Effects of Invention

Therefore, the present disclosure provides an improved easy-to-open gunny sack. In the easy-to-open gunny sack, at least one of upper and lower ends of a sack portion is covered by a clip tape, a single-thread sewing portion formed by single thread sewing is located around the covered portion, an extended clip tape portion formed by extension of the clip tape is formed at both sides of the single-thread sewing portion, an anti-loosening means is provided to the extended clip tape portion of the end portion placed in the sewing proceeding direction such that loosening of the sewing-finished section formed by single thread sewing is prevented from being easily loosened, and an opening identification means is located at a top surface of the finished section so that the user can easily identify the opening identification means and can also easily open the sack through the opening identification means.

In addition, the sewing portion is sewn by only one thread without forming a knotted structure of the binding thread and the opening thread, resulting in reduction in production costs needed for such sewing.

BEST MODE FOR CARRYING OUT THE INVENTION

Figure 1:
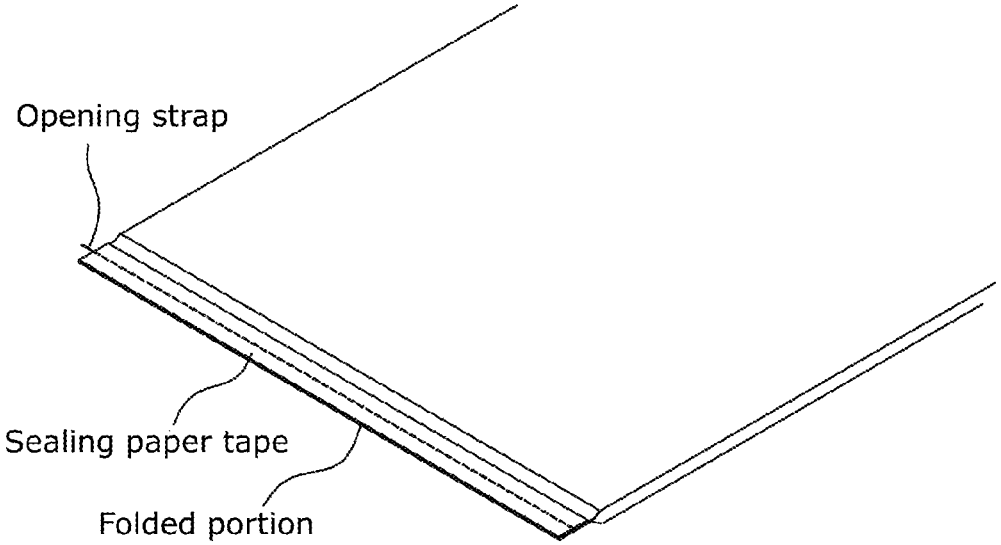
FIG. 1 is a view illustrating an example of a conventional easy open bag according to the related art.
Figure 2:
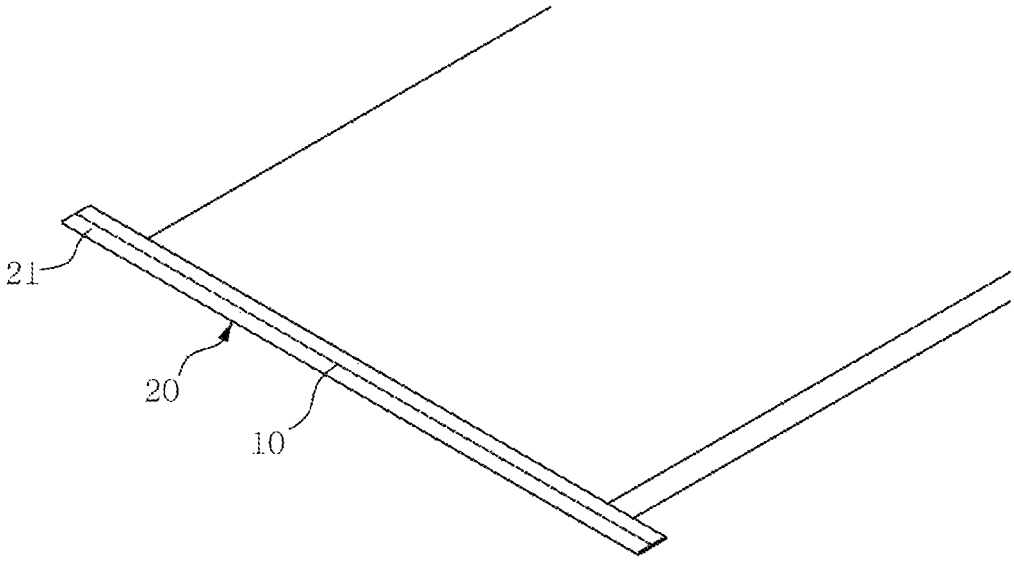
FIGS. 2 and 3 are views illustrating examples of a sewing process according to an embodiment of the present disclosure.
Figure 3:
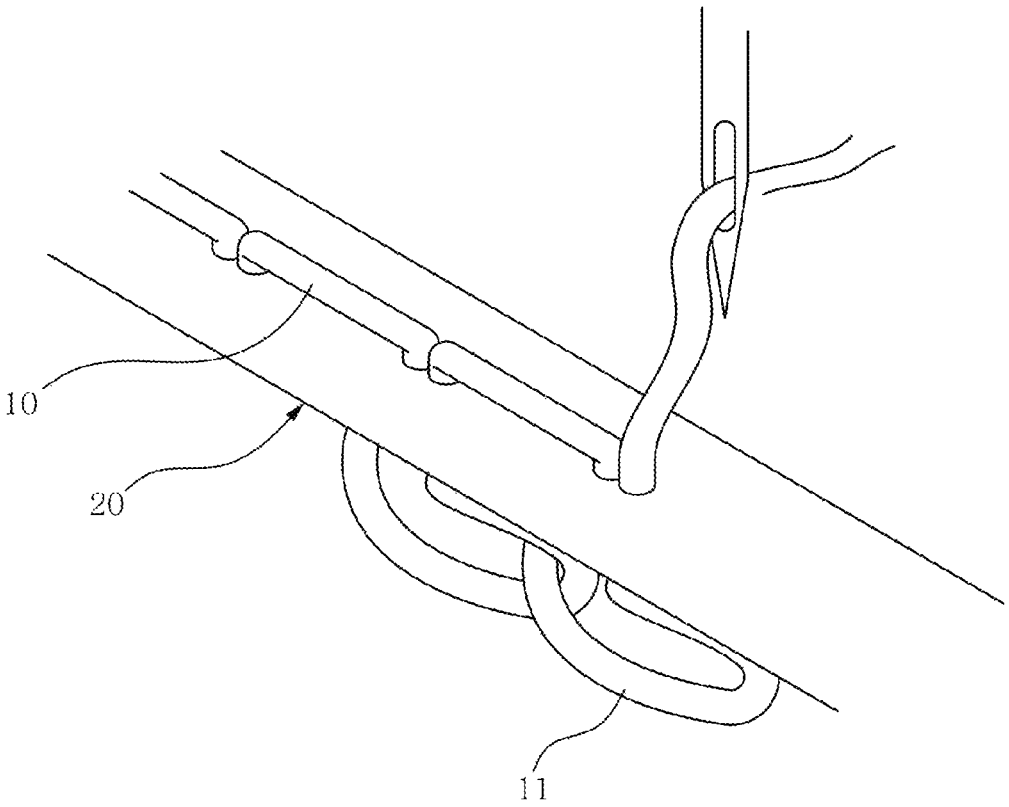
Figure 4:
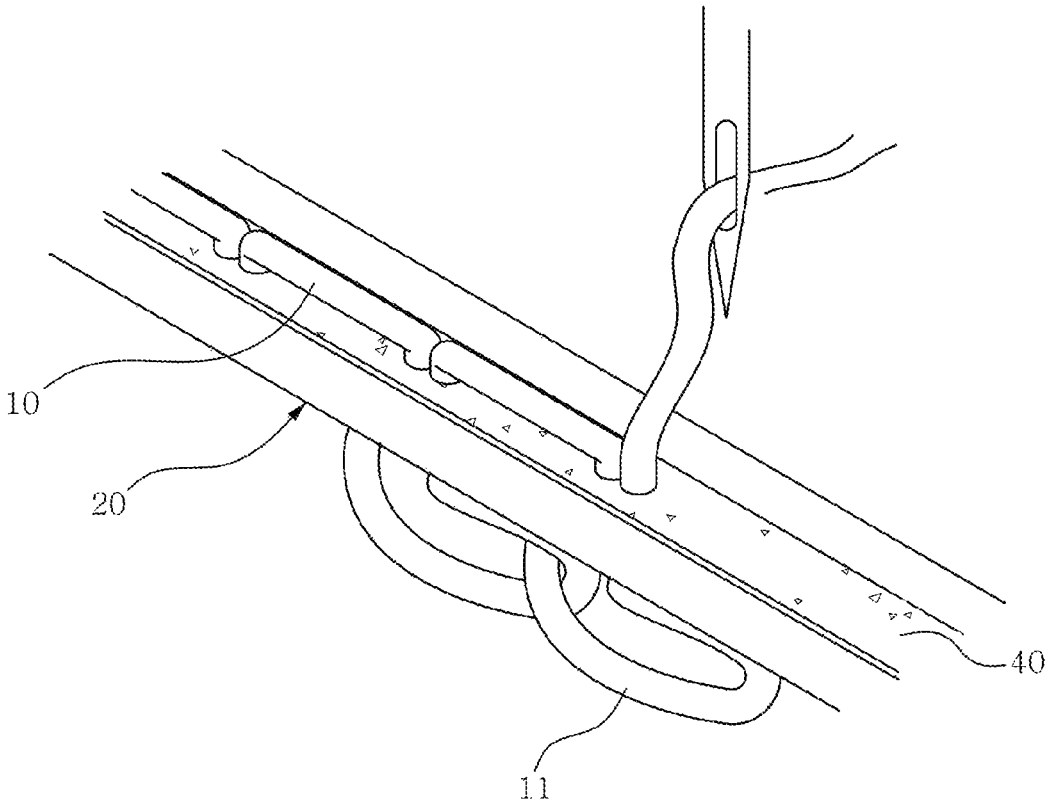
FIG. 4 is a view illustrating an example of a folded portion (made of special paper) and a tape according to another embodiment of the present disclosure.
Figure 5:
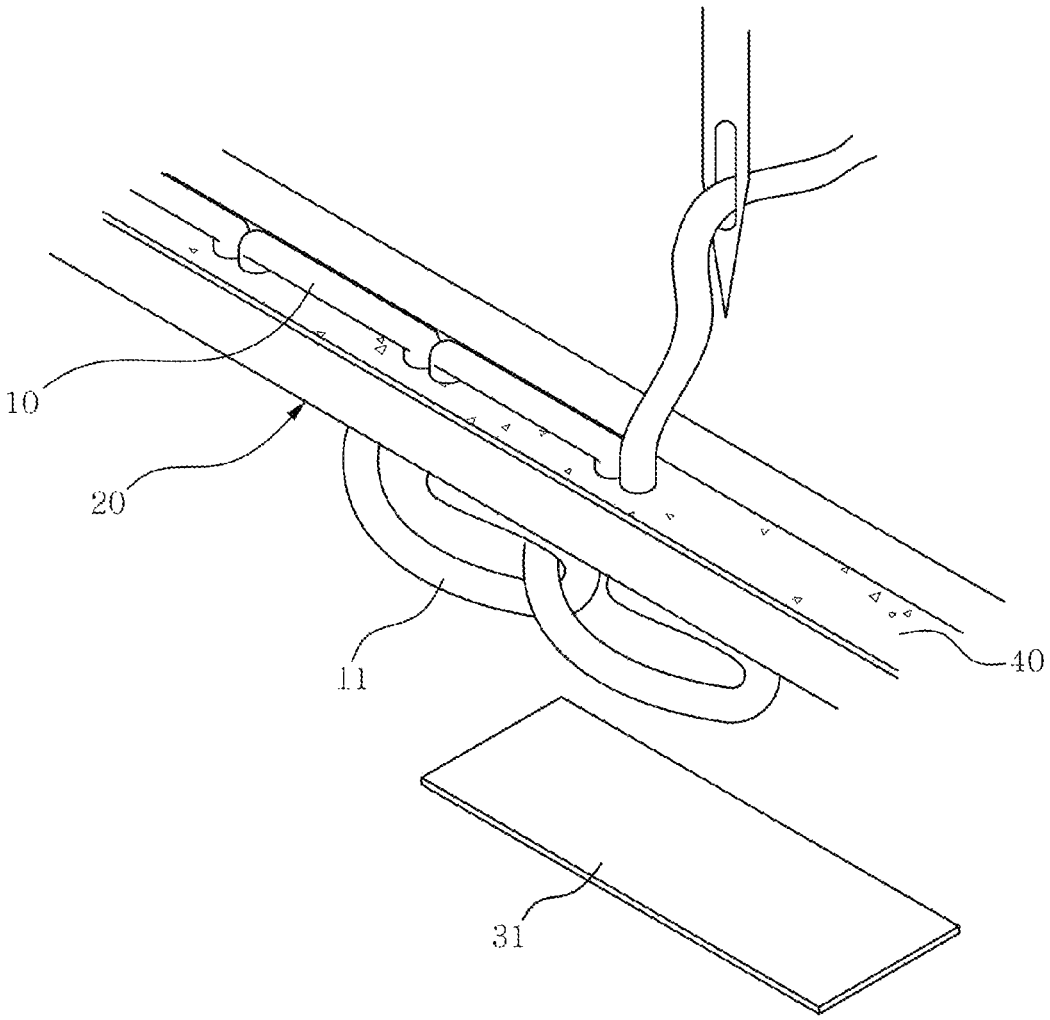
FIG. 5 is a view illustrating an example of an attached state of the anti-loosening tape according to another embodiment of the present disclosure.
Figure 6:
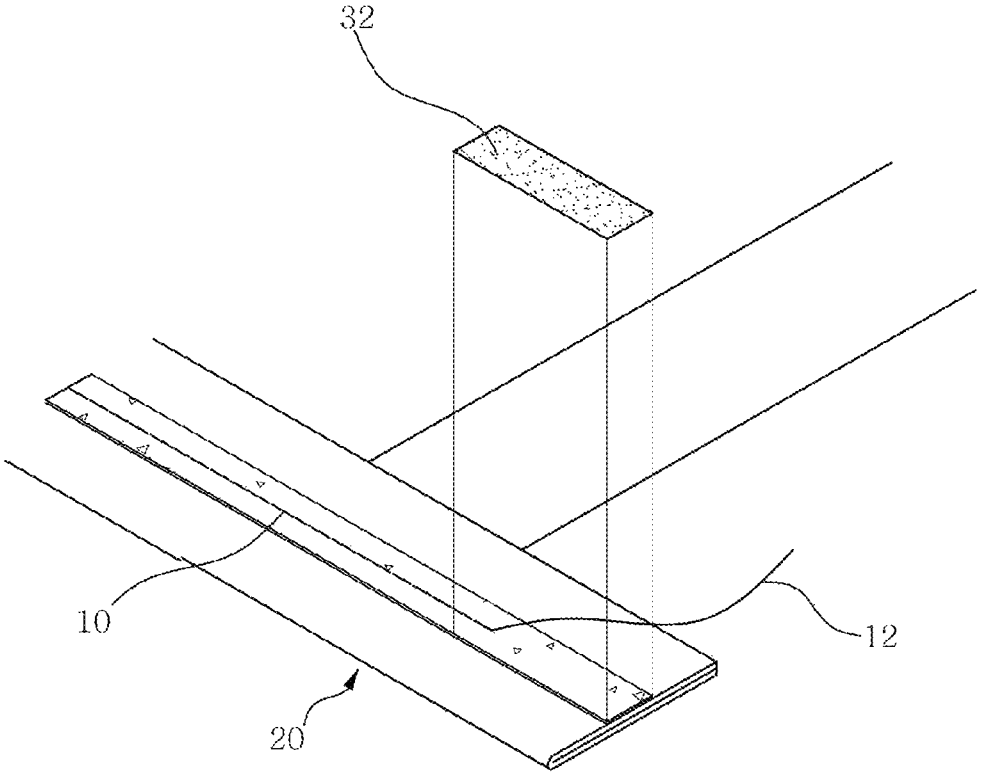
FIG. 6 is a view illustrating a coupling state before the opening identification tape is attached to a sewing portion of the easy-to-open gunny sack according to another embodiment of the present disclosure.
Figure 7:
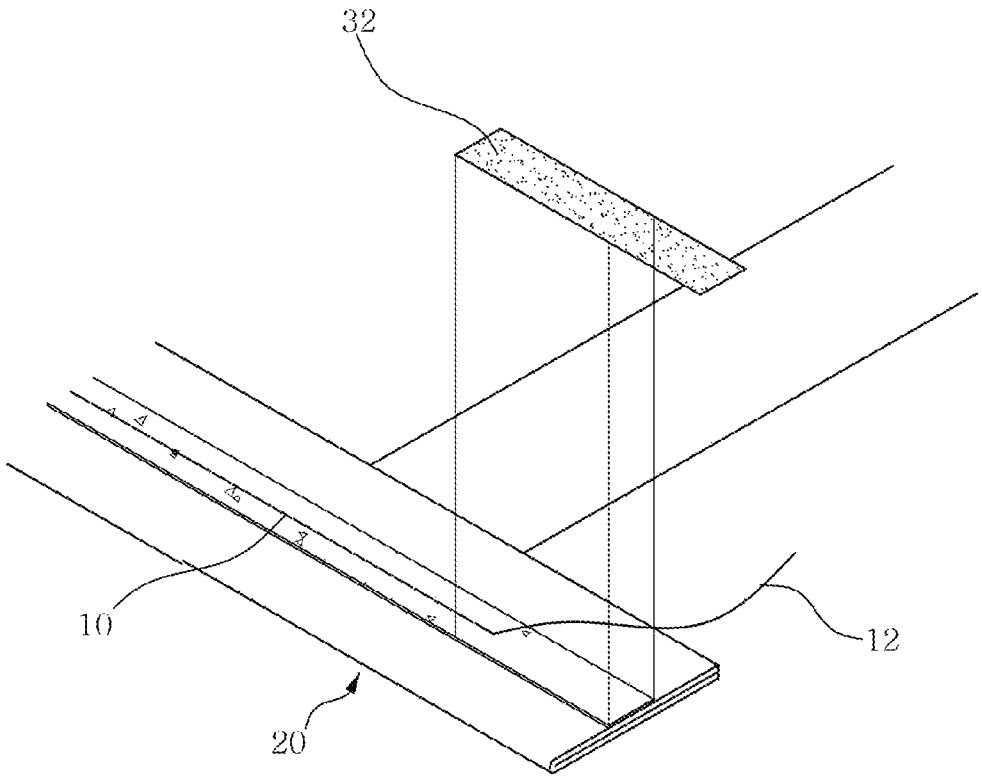
FIG. 7 is a view illustrating an example of an attached state of the opening identification tape according to another embodiment of the present disclosure.
Figure 8:
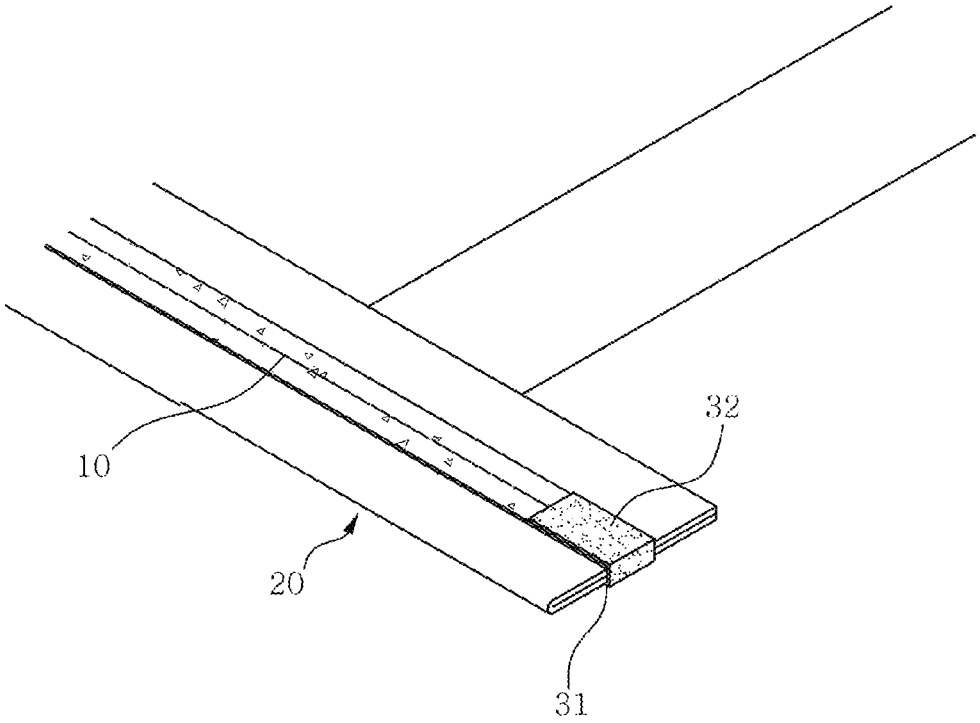
FIG. 8 is a view illustrating an example of an integrated structure of the anti-loosening tape and the opening identification tape according to another embodiment of the present disclosure.

Reference will now be made in detail to embodiments of the present disclosure, examples of which are illustrated in the accompanying drawings.

The present disclosure may minimize the costs of sewing a gunny sack through single thread sewing, may allow a user to easily open the sack, may prevent a sewing-finished section formed by single thread sewing from being easily loosened, and may allow the user to easily identify an opening identification tape and open the sack using the opening identification tape. Prior to description, the terms or words used in the disclosure and the claims are not interpreted as having general meanings or dictionary meanings, but should be interpreted as having meanings and concepts coinciding with the technical scope and sprit of the present disclosure based on the principle in that an inventor may properly define the concept of terms to describe the present disclosure in the best mode.

Therefore, the embodiments described in the specification and shown in the drawings are purely illustrative and are not intended to represent all aspects of the present disclosure, such that various equivalents and modifications may be made without departing from the spirit of the present disclosure.

That is, the easy-to-open gunny sack according to the present disclosure may allow a clip tape 20 to cover at least one of upper and lower ends of the sack portion, may allow a single-thread sewing portion 10 by single thread sewing to be formed around the covered portion, may allow an extended clip tape portion 21 formed by extension of the clip tape 20 to be formed at both sides of the single-thread sewing portion 10, and may allow an anti-loosening means and an opening identification means to be provided at the extended clip tape portion 21 of the end portion placed in the sewing proceeding direction.

In the meantime, according to the embodiment of the present disclosure, the extended clip tape portion 21 may be comprised of three or more stitches formed by single thread sewing.

According to the embodiment of the present disclosure, the anti-loosening means may be formed by injecting an adhesive into the last stitch of the single-thread sewing portion 10.

According to the embodiment of the present disclosure, the anti-loosening means may be implemented by an anti-loosening tape 31. In more detail, a loop portion 11 of the last stitch of the single-thread sewing portion 10 is bonded to a bottom surface of the sewn section of the extended clip tape portion 21, resulting in formation of the anti-loosening tape 31 bonded to the extended clip tape portion 21. As a result, the anti-loosening tape 31 may serve as the anti-loosening means.

Meanwhile, according to the embodiment of the present disclosure, the opening identification means may be implemented by the opening identification tape 32 for enabling the user to easily identify the end portion of the single-thread sewing portion 10. In more detail, the end portion 12 of the sewn section of the single-thread sewing portion 10 is bonded to a top surface of the sewn section of the extended clip tape portion 21, resulting in formation of the opening identification tape 32 attached to the extended clip tape portion 21. As a result, the opening identification tape 32 may serve as the opening identification means.

According to the embodiment of the present disclosure, the opening identification tape 32 may be formed to protrude outward from the extended clip tape portion 21.

According to the embodiment of the present disclosure, the opening identification tape 32 may be formed to have any distinctive color and/or may be formed of fluorescent materials, such that the user can easily identify the opening identification tape 32.

According to the embodiment of the present disclosure, the anti-loosening tape 31 and the opening identification tape 32 may be integrated with each other, such that the outer surface of the end portion of the extended clip tape portion 21 is bonded while being covered with the integrated structure of the tapes 31 and 32.

In addition, a sewing-sealing tape 40 may be provided to any one of both outer surfaces of the clip tape 20 including the single-thread sewing portion 10. In more detail, the sewing-sealing tape 40 formed at any one of both outer surfaces of the clip tape 20 may seal a sewing hole formed by penetration of a sewing needle, and may enable the sewing thread to be press-fitted into the sewing hole.

The sewing-sealing tape 40 may be implemented by the gunny sack that is formed of a high-density paper or a synthetic resin sheet.

A method for implementing the easy-to-open gunny sack according to the present disclosure will hereinafter be described with reference to the attached drawings.

As described above, the above-mentioned easy-to-open gunny sack may allow the clip tape 20 to cover at least one of upper and lower ends of the sack portion, may allow the single-thread sewing portion 10 sewn by single thread sewing to be formed around the covered portion, may allow the extended clip tape portion 21 formed by extension of the clip tape 20 to be formed at both sides of the single-thread sewing portion 10, and may allow the anti-loosening means to be provided at the extended clip tape portion 21 of the end portion placed in the sewing proceeding direction. As a result, the sealed state of the sewing portion of the easy-to-open gunny sack may not be easily released by external impact. In addition, the sewing portion of the easy-to-open gunny sack is implemented by single thread sewing, such that the costs of sewing the gunny sack can be minimized.

Meanwhile, according to the embodiment of the present disclosure, if the extended clip tape portion 21 is implemented by three or more stitches formed by single thread sewing of the single-thread sewing portion 10, the sewing thread of the single-thread sewing portion 10 can be kept at the sufficient amount of tensile force in response to the opening force generated from the center portion of the gunny sack. As a result, the sealed state of the gunny sack can be stably and firmly maintained.

According to the embodiment of the present disclosure, if the anti-loosening means is implemented by injecting the adhesive into the last stitch of the single-thread sewing portion 100, the sewing thread of the last stitch of the single-thread sewing portion 10 is firmly sewn to the extended clip tape portion 21 located around the last stitch, such that the sewing thread of the gunny sack is prevented from being easily loosened by external impact.

According to the embodiment of the present disclosure, the anti-loosening means may be implemented by the anti-loosening tape 31. In more detail, the loop portion 11 of the last stitch of the single-thread sewing portion 10 is bonded to the bottom surface of the sewn section of the extended clip tape portion 21, resulting in formation of the anti-loosening tape 31 bonded to the extended clip tape portion 21. Thus, the anti-loosening tape 31 may serve as the anti-loosening means. By the anti-loosening tape 31, the loop portion 11 exposed from the last stitch of the single-thread sewing portion 10 is bonded to the end portion of the sewing portion, such that the sewn state of the last stitch can be firmly maintained and loosening of the sewn state of the last stitch can be prevented.

According to the embodiment of the present disclosure, the opening identification means may be implemented by the opening identification tape 32 for enabling the user to easily identify the end portion of the single-thread sewing portion 10. In more detail, the end portion 12 of the sewn section of the single-thread sewing portion 10 is bonded to a top surface of the sewn section of the extended clip tape portion 21, resulting in formation of the opening identification tape 32 attached to the extended clip tape portion 21. Thus, the opening identification tape 32 may serve as the opening identification means. In the situation in which the opening identification tape 32 is formed to protrude outward from the extended clip tape 21, the user can easily grasp the opening identification tape 32 in the process of opening the gunny sack, and can thus open the gunny sack using the opening identification tape 32.

In addition, according to the embodiment of the present disclosure, in the situation in which the opening identification tape 32 is formed to have any distinctive color capable of being easily identified by the user, the user can easily identify the opening identification tape 32 in the process of opening the gunny sack, and can thus open the gunny sack.

Meanwhile, according to the embodiment of the present disclosure, in the situation in which the sewing-sealing tape 40 is provided to any one of both outer surfaces of the clip tape 20 including the single-thread sewing portion 10, not only the sewing thread needed for the sewing process, but also the sewing-sealing tape 40 forcibly moves toward the sewing hole. In more detail, the sewing-sealing tape 40 may seal the sewing hole formed by penetration of the sewing needle, and may enable the sewing thread to be press-fitted into the sewing hole. As a result, content stored in the gunny sack can be prevented from leaking outside through the sewing hole, the sewing thread is firmly press-fitted into the sewing hole, and the sewn state of the gunny sack can be firmly kept at high tensile force.

REFERENCE SIGNS LIST

| |
|---|
| 10: Single-thread sewing portion<br>11: Loop portion<br>12: End portion of the sewing portion<br>20: Clip tape<br>21: Extended clip tape portion<br>31: Anti-loosening tape<br>32: Opening identification tape<br>40: Sewing-sealing tape |

The invention claimed is:

1. An easy-to-open gunny sack sewn by a single thread, comprising:

a clip tape (20) formed to cover at least one of upper and lower ends of a sack portion;

a single-thread sewing portion (10) sewn by a single thread in a manner that the single-thread sewing portion (10) is disposed around a portion covered by the clip tape (20);

an extended clip tape portion (21) formed by extension of the clip tape (20) at both sides of the single-thread sewing portion (10);

an anti-loosening means provided in the extended clip tape portion (21) of an end portion placed in a sewing proceeding direction, wherein the extended clip tape portion (21) is formed to include three or more stitches formed by single thread sewing;

an opening identification tape (32) configured in a manner that an end portion (12) of a sewn section of the single-thread sewing portion (10) is bonded to a top surface of a sewn section of the extended clip tape portion (21) for easier identification of the end portion of the single-thread sewing portion (10), resulting in formation of the opening identification tape (32) attached to the extended clip tape portion (21); and a sewing-sealing tape (40) provided to any one of both outer surfaces of the clip tape (20) including the single-thread sewing portion (10), and configured to seal a sewing hole formed by penetration of a sewing needle such that a sewing thread is press-fitted into the sewing hole, wherein the opening identification tape (32) is formed to protrude outward from the extended clip tape portion (21), the opening identification tape (32) is formed to have a fluorescent color such that the opening identification tape (32) is easily identified, the anti-loosening means includes an anti-loosening tape (31) that is bonded to the extended clip tape portion (21) and bonds a loop portion (11) of a final stitch of the single-thread sewing portion (10) to a bottom surface of a sewn section of the extended clip tape portion (21).

* * * * *